US006527653B2

(12) United States Patent
Winfield et al.

(10) Patent No.: US 6,527,653 B2
(45) **Date of Patent: *Mar. 4, 2003**

(54) PENTAGONAL HEXECONTAHEDRON DIMPLE PATTERN ON GOLF BALLS

(75) Inventors: Douglas C. Winfield, Seneca, SC (US); Steven Aoyama, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 14 days.

This patent is subject to a terminal disclaimer.

(21) Appl. No.: 09/800,453

(22) Filed: Mar. 5, 2001

(65) Prior Publication Data

US 2002/0147058 A1 Oct. 10, 2002

(51) Int. Cl.[7] ..... A63B 37/14

(52) U.S. Cl. ..... 473/383; 473/378; 473/379; 473/380; 473/381; 473/382; 473/383

(58) Field of Search ..... 473/378, 379, 473/383, 380, 381, 382; 40/327

(56) References Cited

U.S. PATENT DOCUMENTS

| | | | | | |
|---|---|---|---|---|---|
| 5,149,100 | A | * | 9/1992 | Melvin et al. | 40/327 |
| 5,192,079 | A | * | 3/1993 | Sun et al. | 40/327 |
| 5,259,624 | A | * | 11/1993 | Puckett | 473/383 |
| 5,957,786 | A | * | 9/1999 | Aoyama | 473/379 |
| 6,059,671 | A | * | 5/2000 | Asakura | 473/383 |

OTHER PUBLICATIONS

Williams, Robert. The Geometrical Foundation of Natural Structure. Dover Pub., Inc. New York. 1979. p. 97.

* cited by examiner

*Primary Examiner*—Paul T. Sewell
*Assistant Examiner*—Tom Duong
(74) *Attorney, Agent, or Firm*—Swidler Berlin Shereff Friedman LLP

(57) ABSTRACT

Golf balls are disclosed having novel dimple patterns determined by a pentagonal hexecontahedron. A method of packing dimples according to a pentagonal hexecontahedron is also disclosed. For each disclosed dimple pattern, a pentagonal hexecontahedron extend from a pole of the golf ball and dimples are positioned on the golf ball surface according to a pentagonal hexecontahedron.

19 Claims, 6 Drawing Sheets

PENTAGONAL HEXECONTAHEDRON DIMPLE PATTERN ON GOLF BALLS

TECHNICAL FIELD OF THE INVENTION

The present invention generally relates to golf balls, and more particularly, to a golf ball having unique dimple patterns.

BACKGROUND OF THE INVENTION

Golf balls were originally made with smooth outer surfaces. In the late nineteenth century, players observed that the guttie golf balls traveled further as they got older and more gouged up. The players then began to roughen the surface of new golf balls with a hammer to increase flight distance. Manufacturers soon caught on and began molding non-smooth outer surfaces on golf balls.

By the mid 1900's, almost every golf ball being made had 336 indents arranged in an octahedral pattern. Generally, these balls had about 60% of their outer surface covered by dimples. In 1983, Titleist introduced the TITLEIST 384, which had 384 dimples that were arranged in an icosahedral pattern. About 76% of its outer surface was covered with dimples. Today's dimpled golf balls travel nearly two times farther than a similar ball without dimples.

The dimples on a golf ball are important in reducing drag and providing lift. Drag is the air resistance that acts on the golf ball in the opposite direction from the balls flight direction. As the ball travels through the air, the air surrounding the ball has different velocities and, thus, different pressures. The air exerts maximum pressure at the stagnation point on the front of the ball. The air then flows over the sides of the ball and has increased velocity and reduced pressure. At some point it separates from the surface of the ball, leaving a large turbulent flow area called the wake that has low pressure. The difference in the high pressure in front of the ball and the low pressure behind the ball slows the ball down. This is the primary source of drag for a golf ball.

The dimples on the ball create a turbulent boundary layer around the ball, i.e., the air in a thin layer adjacent to the ball flows in a turbulent manner. The turbulence energizes the boundary layer and helps the turbulent boundary layer stay attached to the ball's surface further around the ball to reduce the area of the wake. This greatly increases the pressure behind the ball and substantially reduces the drag.

Lift is the upward force on the ball that is created from a difference in pressure on the top of the ball to the bottom of the ball. The difference in pressure is created by a warpage in the air flow resulting from the ball's back spin. Due to the back spin, the top of the ball moves with the air flow, which delays the separation to a point further rearward. Conversely, the bottom of the ball moves against the air flow, moving the separation point forward. This asymmetrical separation creates an arch in the flow pattern, requiring the air over the top of the ball to move faster, and thus have lower pressure than the air underneath the ball.

Almost every golf ball manufacturer researches dimple patterns in order to increase the distance traveled by a golf ball. A high degree of dimple coverage is beneficial to flight distance, but only if the dimples are of a reasonable size. Dimple coverage gained by filling spaces with tiny dimples is not very effective, since tiny dimples are not good turbulence generators. Most balls today still have many large spaces between dimples or have filled in these spaces with very small dimples that do not create enough turbulence at average golf ball velocities.

There are many patents directed to dimple patterns. U.S. Pat. No. 5,201,522 discloses a golf ball with a dimple pattern that includes a pentagon formation of dimples at each of the poles and has five equally-spaced triangular formations of a plurality of dimples between each polar pentagon formation and the equator.

There continues to be a need for dimple patterns that increase lift and decrease drag. More particularly, there continues to be a need for dimple patterns that have the same lift and drag from all orientations.

SUMMARY OF THE INVENTION

The present invention provides a golf ball with an outer surface that has dimples positioned according to a pentagonal hexecontahedron.

The present invention also provides for a golf ball with an outer surface that has dimples positioned on each hemisphere of the golf ball surface according to a portion of a pentagonal hexecontahedron, which extends from each pole to the parting line.

The present invention further provides a method of packing dimples on the outer surface of a golf ball according to a pentagonal hexecontahedron.

The present invention comprises a golf ball dimple pattern based upon a pentagonal hexecontahedron. A preferred embodiment is comprised of a three-dimensional geometric structure composed of 92 vertices that are connected by 150 edges to form 60 pentagonal regions. The 92 vertices are composed of 12 $V_5$ vertices, where each $V_5$ vertex is a vertex shared by five adjacent pentagonal regions, and 80 $V_3$ vertices, where each $V_3$ vertex is a vertex shared by three adjacent pentagonal regions. Preferably, the total number of dimples is about 200 to about 700. More preferably, the total number of dimples is about 300 to about 500. The diameter and depth of the dimples that make up the dimple patterns of the present invention may be substantially the same or the diameter and depth of the dimples may vary. The dimples may have a diameter of about 0.09 inches to 0.2 inches. More preferably, the dimples may have a diameter of about 0.11 inches to 0.19 inches. Most preferably, the dimples may have a diameter of about 0.13 inches to 0.19 inches. Based upon the size of the dimples positioned according to the pentagonal hexecontahedron pattern, dimples may be centered at the vertices, along the edges, and on or in proximity to the pentagonal regions.

Orientation of the pentagonal hexecontahedron pattern can be positioned any where on the golf ball's outer surface. The pattern may also be oriented based upon the parting line. The parting line is located at the equator of the outer surface, there by dividing the outer surface into the two hemispheres. Each hemisphere has a pole positioned at the furthest point on the outer surface from the parting line. The pentagonal hexecontahedron may originate at and extend toward the parting line from a pole with a $V_5$ vertex. A first set of dimples, which may vary in size, may be centered on the ball surface at selected vertices and edges of the pentagonal hexecontahedron except where, if dimples were placed, the dimples would intersect or cross the parting line. When space on the edges is available, additional dimples may also be centered along the edges except where, if dimples were placed, the dimples would intersect or cross the parting line. The remaining uncovered surface may then be filled with dimples that have sizes large enough to aid in reducing drag and providing lift. Preferably, the percentage of the golf ball surface covered by dimples ranges is greater than about 68%.

An embodiment of the present invention is a golf ball with an outer surface having 322 dimples according to the pentagonal hexecontahedron pattern. Dimples used to create the pattern may be of a first, a second, a third, and a fourth size. Based upon the diameter of the golf ball, a pentagonal hexecontahedron pattern may extend from the poles towards the parting line of the outer surface with a $V_5$ vertex and a first size dimple centered at each pole. A second size dimple may then be centered at each of the other vertices of the pentagonal hexecontahedron only if the centered dimple would not intersect the parting line. Where space is available, additional second size dimples may also be centered along the edges of the pentagonal hexecontahedron. To minimize the portion of the outer surface that is not dimpled, reduce drag, and increase lift, the remainder of the golf ball surface may then be covered with the second, third, and fourth size dimples only at positions where the dimples do not intersect or cross the parting line.

Another embodiment of the present invention is a golf ball surface having 332 dimples according to the pentagonal hexecontahedron pattern. This embodiment may have dimples of a first, a second, and a third size. The pattern may be based upon the diameter of the golf ball and may extend from each pole toward the parting line of the outer surface with a $V_5$ vertex and a first size dimple centered at each pole. A first size dimple may be centered at each of the pentagonal hexecontahedron's $V_5$ vertices and second size dimples may be centered at each of the pentagonal hexecontahedron's $V_3$ vertices only where the centered dimple would not intersect or cross the parting line. Where space is available and where a dimple would not intersect or cross the parting line, second size dimples may also be centered along each edge that connects a $V_5$ vertex and a $V_3$ vertex of the pentagonal hexecontahedron. The remainder of the golf ball's outer surface may then be covered with second and third size dimples that do not intersect or cross the parting line. This pattern may result in a 69% of the golf ball surface being covered by dimples.

Another embodiment of the present invention is a golf ball with an outer surface having 320 dimples according to the pentagonal hexecontahedron pattern. Dimples used to create the pattern may be of a first, a second, a third, and a fourth size. Based upon the diameter of the golf ball, a pentagonal hexecontahedron pattern may extend from a $V_5$ vertex at a pole towards the parting line of the outer surface. A first size dimple may be centered at each of the vertices of the pentagonal hexecontahedron only if the dimple is not centered at a pole or the dimple would not intersect the parting line. A second size dimple and three third size dimples may be positioned within each of the pentagonal regions that share the $V_5$ vertex centered at a pole. Where space is available, additional first size dimples may also be centered along the edges of the pentagonal hexecontahedron. To minimize the portion of the outer surface that is not dimpled, reduce drag, and increase lift, the remainder of the golf ball surface may then be covered with the second, third, and fourth size dimples only at positions where the dimples do not intersect or cross the parting line.

Another embodiment of the present invention is a golf ball surface having 460 dimples of a single size oriented according to the pentagonal hexecontahedron pattern. The pattern may be based upon the diameter of the golf ball and may extend from each pole toward the parting line of the outer surface with a $V_5$ vertex centered at each pole. Dimples may be positioned between the edges of each of the pentagonal regions only if the positioned dimples would not intersect or cross the parting line.

DETAILED DESCRIPTION

The following description of the pentagonal hexecontahedron dimple patterns will be for the formation of a pattern on a first hemisphere of a golf ball. Although not discussed, the pattern can be extended on to or repeated on the golf ball's second hemisphere. The pentagonal hexecontahedron or parts thereof mentioned in this application have no physical manifestation upon the golf ball. Rather, they are only geometric guides for dimple placement.

Figure 1:
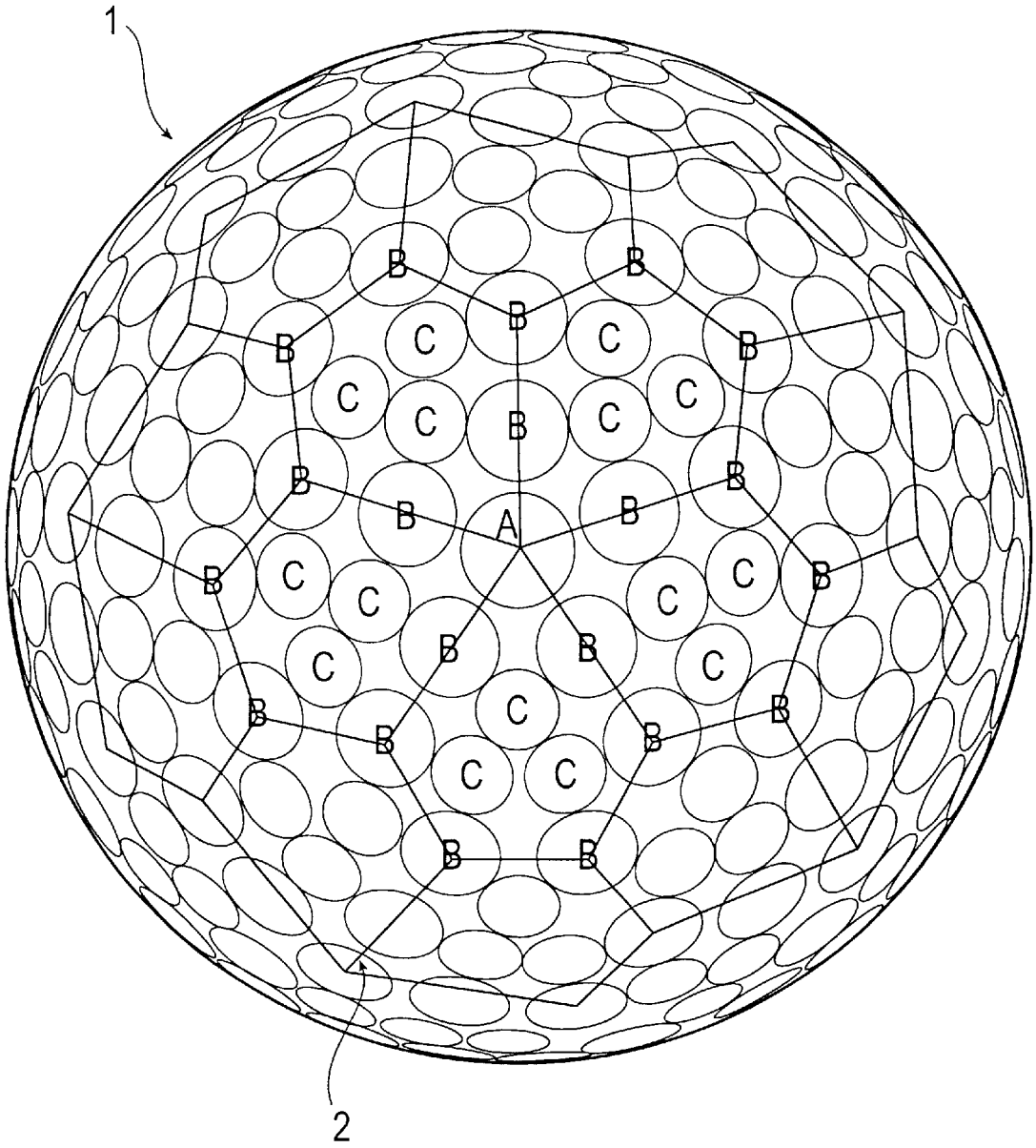
FIG. 1 is a golf ball surface with a dimple pattern based upon a pentagonal hexecontahedron that is formed with dimples of varying size.
Figure 2:
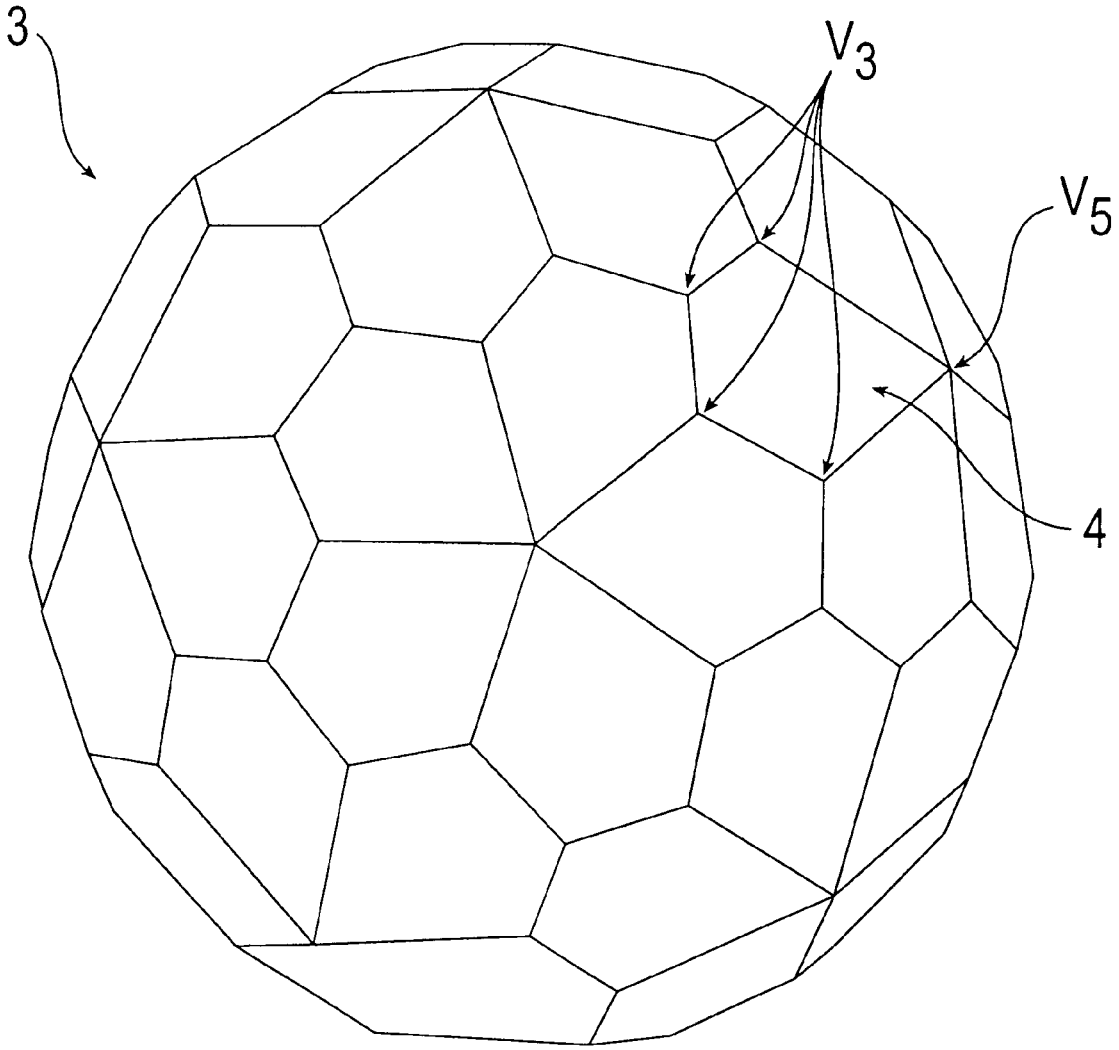
FIG. 2 is a pentagonal hexecontahedron.

FIG. 1 shows a golf ball surface 1, which has a dimple pattern corresponding to an embodiment of the claimed invention. The pattern 2 for placement of various sized dimples on the golf ball surface is based upon a pentagonal hexecontahedron with each letter representing a dimple of a specific size. FIG. 2 shows a pentagonal hexecontahedron 3, which has 12 $V_5$ vertices and 80 $V_3$ vertices, and 150 edges. Each edge connects either two $V_3$ vertices or a $V_3$ vertex with a $V_5$ vertex. This results with each pentagonal region 4 of the pentagonal hexecontahedron having one $V_5$ and four $V_3$ vertices connected by five edges.

Figure 3:
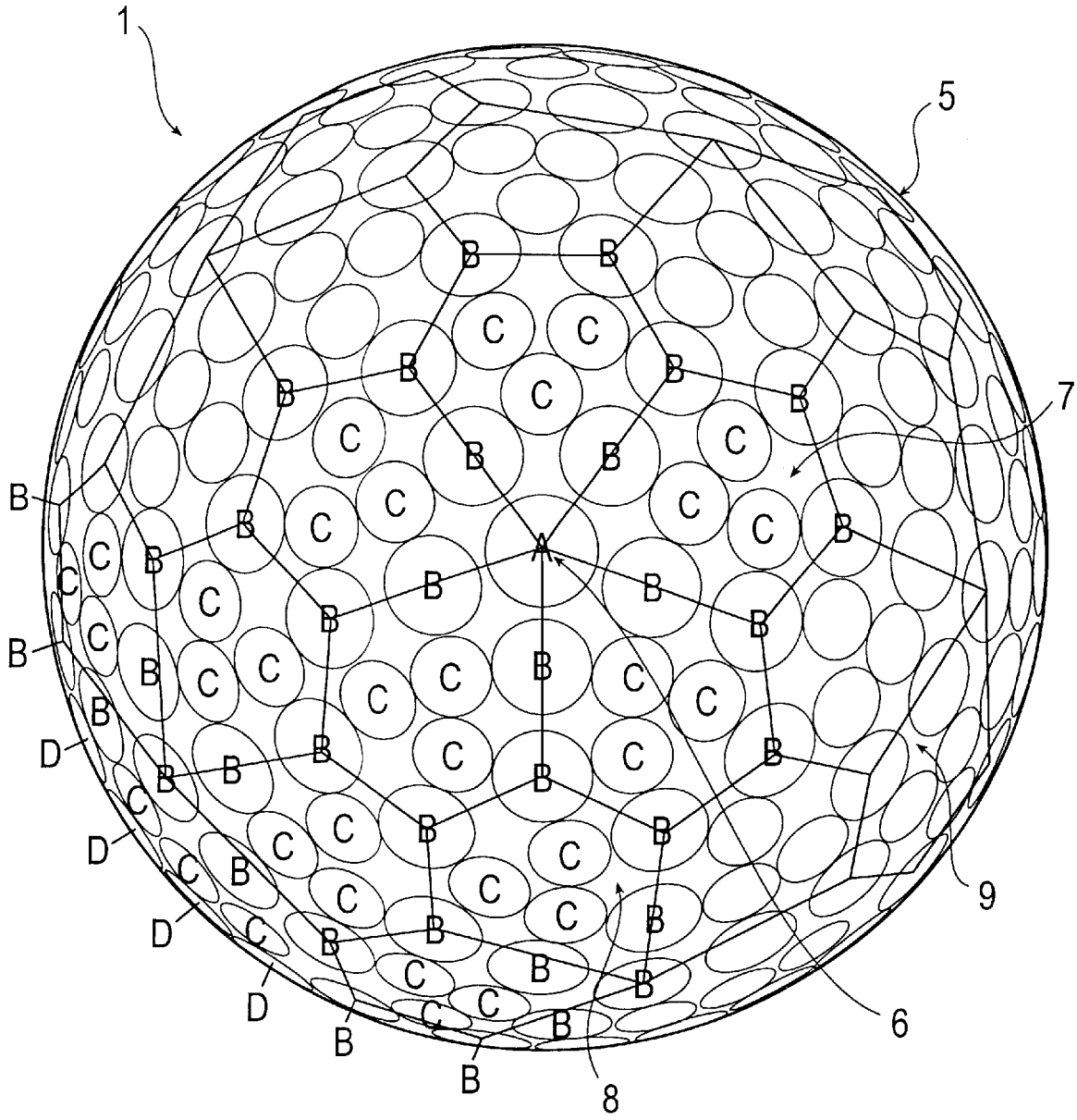
FIG. 3 is a polar view of the first embodiment of a golf ball having a pentagonal hexecontahedron pattern formed by dimples of varying sizes.

FIG. 3 shows a view of an embodiment of the present invention. The view is of a golf ball surface 1 having a parting line 5 and a pole 6. In this embodiment, four different size dimples; A, B, C, and D, are used to create the pentagonal hexecontahedron dimple pattern. Dimple A has the largest diameter, dimple B has a diameter larger than dimple C and D, and dimple C has a smaller diameter than dimple D. The preferred dimple sizes for this embodiment are set forth in Table 1.

TABLE 1

| Dimple | Diameter (inches) |
|---|---|
| A | 0.19 |
| B | 0.17 |
| C | 0.14 |
| D | 0.16 |

A partial pentagonal hexecontahedron pattern that corresponds to the golf ball's diameter originates at the pole 6 and covers the hemisphere. An A dimple is centered at the pole 6, which is the location for a $V_5$ vertex of a first set of connected but not overlapping five pentagons 7. This first set of pentagons 7 radiates out from the pole 6 towards the parting line 5. From the $V_3$ vertices of those five pentagons, a second set of connected but not overlapping pentagons 8 radiates out further towards the parting line 5. Finally, a third set of connected but not overlapping pentagons 9 extends from the $V_5$ vertices of the second set of pentagons 8. On each edge of the first set of pentagons that radiates out from the A dimple positioned at the pole 6, one B dimple is placed at the center of the edge and another B dimple is placed at the $V_3$ vertex. For all other vertices in the first set of pentagons 7 and all vertices in the second set of pentagons 8, a B dimple is placed at each vertex. For each edge that radiates out from a $V_5$ vertex to a $V_3$ vertex in the second set of pentagons 8, a B dimple is positioned at the center of each edge. For each vertex of the third set of pentagons 9, a B dimple is placed on the vertex; however, no dimple is placed on a vertex where, if the dimple were placed on the vertex, the dimple would intersect or cross the parting line 5.

Figure 4:
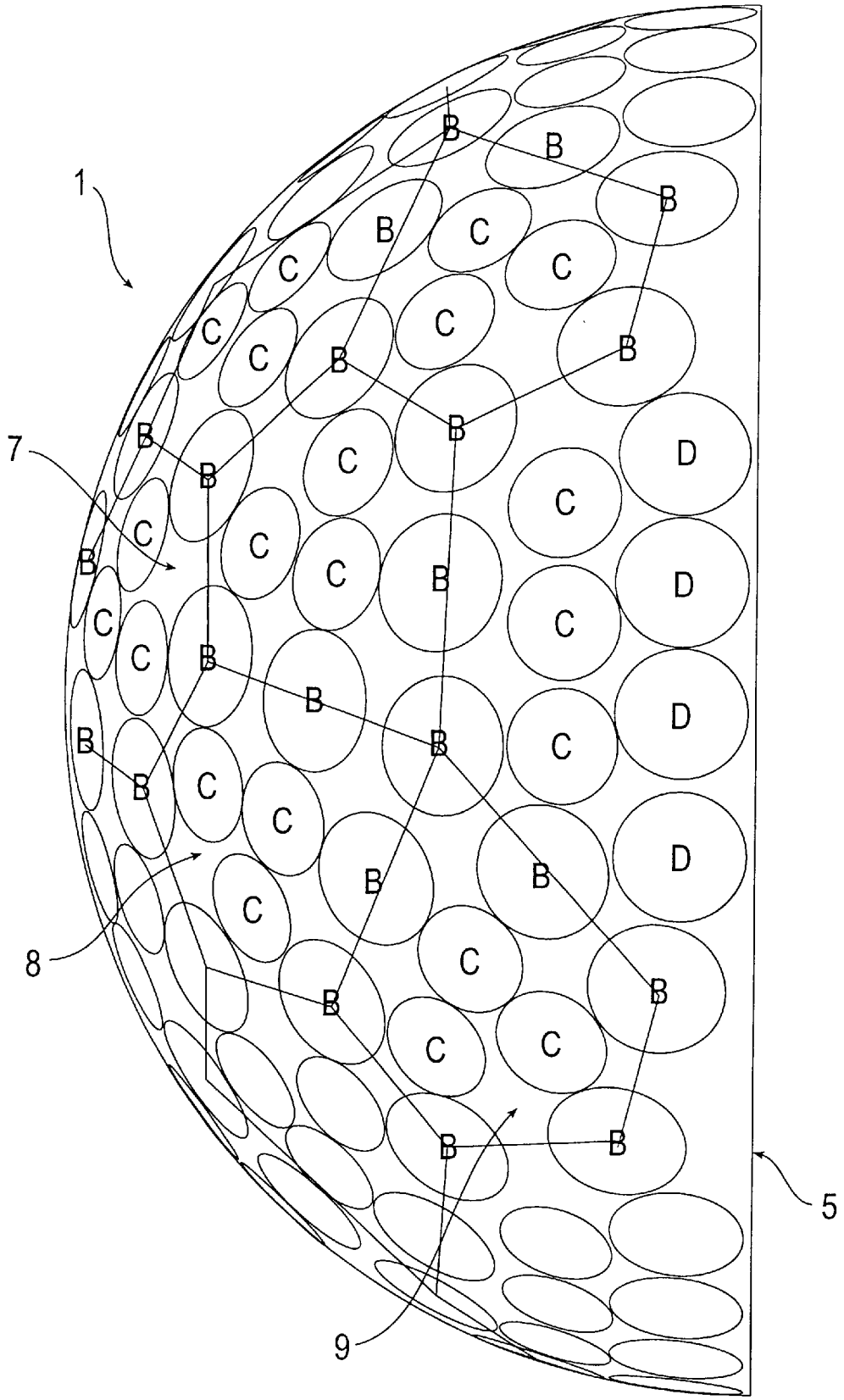
FIG. 4 is a equatorial view of the first embodiment of a golf ball having a pentagonal hexecontahedron pattern formed by dimples of varying sizes.

FIG. 4 is an equatorial view of this embodiment of a golf ball's surface 1 having a dimple pattern based upon a pentagonal hexecontahedron. As shown, B dimples are positioned at vertices of the first set of pentagons 7 and the second set of pentagons 8. B dimples are also positioned at the vertices of the third set of pentagons 9, except no dimples are positioned at vertices where if dimples were positioned on vertices, the dimple would intersect or cross the parting line 5. The remaining uncovered surface of the golf ball hemisphere, except for the parting line 5, is then filled with C and D dimples to aid in reducing drag and providing lift.

In another embodiment of the present invention, there are three different sized dimples; A, B, and C, whose diameters are listed in TABLE 1. A partial pentagonal hexecontahedron pattern that corresponds to the golf ball's diameter originates at the pole and covers the hemisphere. An A dimple is centered at the pole, which is the location for the $V_5$ vertex of a first set of five pentagons. These five pentagons are connected, but do not overlap one another and radiate out from the pole towards the parting line. From the $V_3$ vertices of those five pentagons, a second set of connected but not overlapping pentagons radiate out further towards the parting line. Finally, a third set of connected but not overlapping pentagons extend from the $V_5$ vertices of the second set of pentagons. On each edge of the first set of pentagons that radiates out from the A dimple positioned at the pole to a $V_3$ vertex, one B dimple is placed at the center of the edge and another B dimple is placed at the $V_3$ vertex. B dimples are also positioned at $V_3$ vertices in the first or second set of pentagons, and A dimples are positioned at all $V_5$ vertices of the second set of pentagons. For each edge that radiates out from a $V_5$ vertex to a $V_3$ vertex of the second set of pentagons, a B dimple is positioned at the center of each edge. A B dimple is also positioned at each $V_3$ vertex of the third set of pentagons, except no dimple is positioned at a vertex where, if a dimple was positioned on the vertex, the dimple would intersect or cross the parting line. The remaining uncovered surface of the golf ball hemisphere, except for the parting line, is then filled with B and C dimples to aid in reducing drag and providing lift. This dimple pattern of a golf ball hemisphere comprises of 166 dimples and covers 69% of the golf ball hemisphere.

Figure 5:
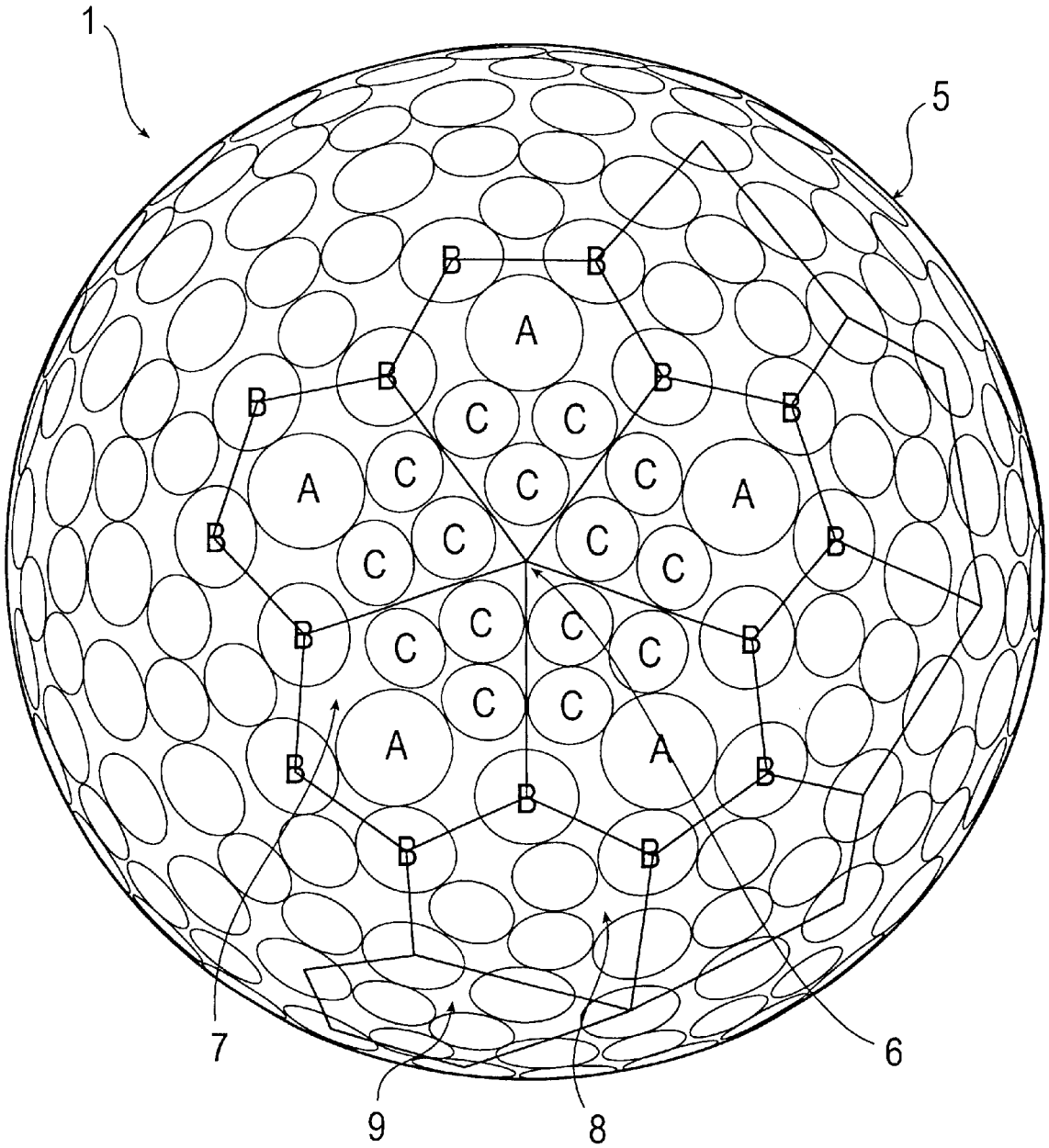
FIG. 5 is a polar view of a third embodiment of a golf ball having a pentagonal hexecontahedron pattern formed by dimples of varying size.

FIG. 5 shows a view of another embodiment of the present invention. In this embodiment, 320 dimples comprising four different size dimples, A, B, C, and D, are used to create the pentagonal hexecontahedron dimple pattern with each dimple having a diameter set forth in Table 1. A partial pentagonal hexecontahedron pattern that corresponds to the golf ball's diameter originates at the pole with a $V_5$ vertex and covers the hemisphere. A first set of connected but not overlapping pentagons 7 radiates out from the pole 6 towards the parting line 5. From the $V_3$ vertices of those five pentagons, a second set of connected but not overlapping pentagons 8 radiates out further towards the parting line 5. Finally, a third set of connected but not overlapping pentagons 9 extends from the $V_5$ vertices of the second set of pentagons 8. A B dimple is centered at each $V_3$ vertex of the first set of pentagons and at each vertex in the second set of pentagons 8. For each edge that radiates out from a $V_5$ vertex to a $V_3$ vertex in the second set of pentagons 8, a B dimple is positioned at the center of each edge. For each vertex of the third set of pentagons 9, a B dimple is placed on the vertex; however, no dimple is placed on a vertex where, if the dimple were placed on the vertex, the dimple would intersect or cross parting line 5. The remaining uncovered surface of the golf ball hemisphere, except for the parting line 5, is then filled with A, B, C, and D dimples to aid in reducing drag and providing lift.

Figure 6:
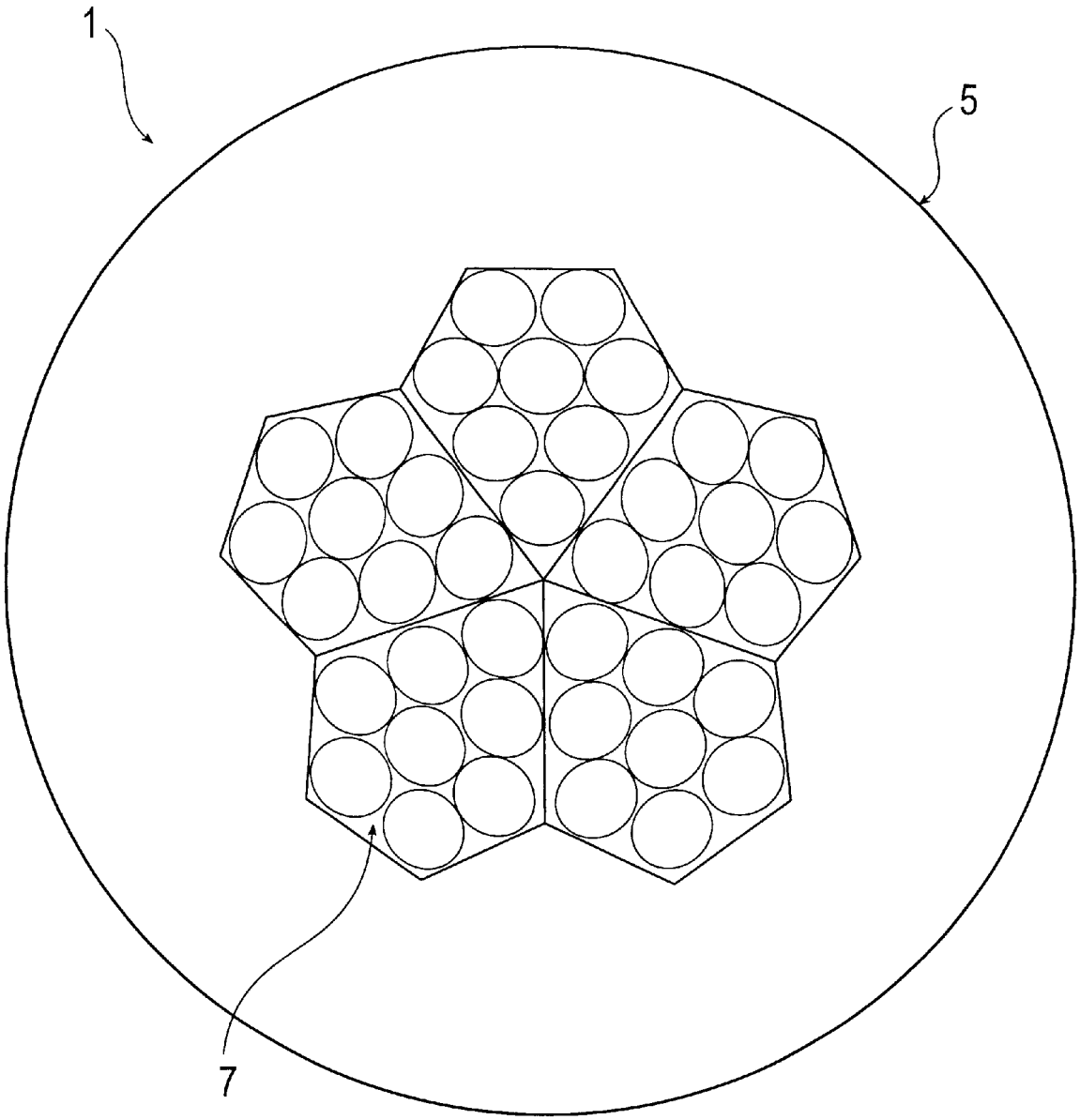
FIG. 6 is a polar view of a fourth embodiment of a golf ball having a pentagonal hexecontahedron pattern formed by dimples of the same size.

FIG. 6 shows a view of another embodiment of the present invention. In this embodiment, 460 dimples of a single size with each dimple having a diameter of about 0.12 to 0.15 inches and more preferably about 0.13 inches is used to create the pentagonal hexecontahedron dimple pattern. A partial pentagonal hexecontahedron pattern that corresponds to the golf ball's diameter originates at the pole with a $V_5$ vertex and covers the hemisphere. A first set of connected but not overlapping pentagons 7 radiates out from the pole 6 towards the parting line 5. From the $V_3$ vertices of those five pentagons, a second set of connected but not overlapping pentagons 8 radiates out further towards the parting line 5. Finally, a third set of connected but not overlapping pentagons 9 extends from the $V_5$ vertices of the second set of pentagons 8. Eight dimples are positioned within the edges of each pentagonal region; however, no dimple is positioned where, if the dimple were positioned, the dimple would intersect or cross the parting line 5.

While various descriptions of the present invention are described above, it should be understood that the various features can be used singly or in any combination thereof. Therefore, this invention is not to be limited to only the specifically preferred embodiments depicted herein. Further, it should be understood that variations and modifications within the spirit and scope of the invention may occur to those skilled in the art to which the invention pertains. Accordingly, all expedient modifications readily attainable by one versed in the art from the disclosure set forth herein that are within the scope of invention are to be included as further embodiments of the present invention.

All patents cited in the foregoing text are expressly incorporated herein by reference in their entirety.

What is claimed is:

1. A golf ball comprising a plurality of dimples wherein placement of at least a portion of the plurality of dimples are defined by a pentagonal hexecontahedron.

2. The golf ball of claim 1, wherein the dimples have a diameter and a depth, and the diameter and depth of each dimple are substantially the same.

3. The golf ball of claim 1, wherein at least one dimple is a different size than another dimple.

4. The golf ball of claim 1, wherein the plurality of dimples do not intersect a parting line.

5. A golf ball comprising:

an outer surface having a first pole, a second pole, a first hemisphere, and a second hemisphere; and a plurality of dimples;

wherein placement of at least a portion of the plurality of dimples on the first hemisphere is defined by a pentagonal hexecontahedron and originates with a first $V_5$ vertex at the first pole; and further wherein placement of at least a portion of the plurality of dimples on the second hemisphere is defined by a pentagonal hexecontahedron and originates with a second $V_5$ vertex at the second pole.

6. The golf ball of claim 5, wherein the plurality of dimples do not intersect a parting line.

7. The golf ball of claim 6, wherein the plurality of dimples have a diameter and a depth that are substantially the same.

8. The golf ball of claim 6, wherein the plurality of dimples have different diameters and depths.

9. The golf ball of claim 8, wherein an A dimple is centered at each of a number of $V_5$ vertices on the first hemisphere and an A dimple is centered at each of a number of $V_5$ vertices on the second hemisphere.

10. The golf ball of claim 9, wherein a number of B dimples are centered at a number of $V_3$ vertices and a number of B dimples are centered along a number of edges that connect $V_5$ and $V_3$ vertices on the first hemisphere and the second hemisphere.

11. The golf ball of claim 10, wherein a number of B dimples, a number of C dimples, and a number of D dimples are positioned on a non-dimpled portion of the outer surface.

12. The golf ball of claim 11, wherein the number of A dimples is 2, the number of B dimples is 130, the number of C dimples is 150, and the number of D dimples is 40.

13. The golf ball of claim 8, wherein an A dimple is centered at the first pole and an A dimple is centered at the second pole.

14. The golf ball of claim 13, wherein a number of B dimples are centered at a number of $V_5$ vertices, a number of B dimples are centered at a number of $V_3$ vertices, and a number of B dimples are centered along a number of edges that connect $V_5$ and $V_3$ vertices on the first hemisphere and the second hemisphere.

15. The golf ball of claim 14, wherein a number of B dimples and a number of C dimples are positioned on a non-dimpled portion of the outer surface.

16. The golf ball of claim 15, wherein the number of A dimples is 12, the number of B dimples is 140, the number of C dimples is 180.

17. A method of packing dimples on a golf ball, comprising the steps of:

(a) orienting a pentagonal hexecontahedron, which has a number of vertices and edges, on the golf ball;

(b) placing dimples on the golf ball at positions that correspond to the vertices and edges of the pentagonal hexecontahedron; and (c) positioning dimples on non-dimpled portion of the golf ball.

18. The method of claim 17, wherein the step of orienting includes positioning a $V_5$ vertex of the pentagonal hexecontahedron at a pole of the golf ball.

19. The method of claim 18, wherein the step of placing includes dimples that do intersect or cross a parting line.

* * * * *